US006752898B1

(12) United States Patent
Anderson, II et al.

(10) Patent No.: US 6,752,898 B1
(45) Date of Patent: Jun. 22, 2004

(54) METHOD AND APPARATUS FOR AN AIR BEARING PLATEN WITH RAISED TOPOGRAPHY

(75) Inventors: Robert L. Anderson, II, Fremont, CA (US); Robert Charatan, Portland, OR (US); Travis Robert Taylor, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/327,565

(22) Filed: Dec. 20, 2002

(51) Int. Cl.[7] ..... B24B 21/00

(52) U.S. Cl. ..... 156/345.12; 451/8; 451/81; 451/66

(58) Field of Search ..... 451/8, 307, 296, 451/66, 81; 156/345.12, 345.13, 345.14

(56) References Cited

U.S. PATENT DOCUMENTS 6,186,865 B1 * 2/2001 Thornton et al. ..... 451/8
6,609,961 B2 * 8/2003 Lacy et al. ..... 451/296
6,620,035 B2 * 9/2003 Xu ..... 451/307
6,656,025 B2 * 12/2003 Pant et al. ..... 451/56

* cited by examiner

*Primary Examiner*—Gregory Mills
*Assistant Examiner*—Sylvia R. MacArthur
(74) *Attorney, Agent, or Firm*—Martine & Penilla, LLP

(57) ABSTRACT

An invention is provided for a CMP apparatus that enhances removal rate uniformity. The CMP apparatus includes a polishing belt disposed below a carrier head that is capable of applying a wafer to the polishing belt. Also included is a platen disposed below the polishing belt. The platen includes a circular shim section disposed on the top surface of the platen. The circular shim section is higher than the top surface of the platen. When using this configuration, increasing pressure to the backside of the polishing belt decreases the edge removal rate of the wafer. Conversely, decreasing pressure to the backside of the polishing belt increases the edge removal rate of the wafer.

14 Claims, 11 Drawing Sheets

METHOD AND APPARATUS FOR AN AIR BEARING PLATEN WITH RAISED TOPOGRAPHY

BACKGROUND OF THE INVENTION

1. Field of the Invention

This invention relates generally to chemical mechanical planarization apparatuses, and more particularly to methods and apparatuses for improved edge performance using an air bearing with a raised topography to constrain airflow under a wafer.

2. Description of the Related Art

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess material.

A chemical mechanical planarization (CMP) system typically is utilized to polish a wafer as described above. A CMP system generally includes system components for handling and polishing the surface of a wafer. Such components can be, for example, a rotary polishing pad, an orbital polishing pad, or a linear belt polishing pad. The pad itself typically is made of a polyurethane material or polyurethane in conjunction with other materials such as, for example, a stainless steel belt. In operation, the belt pad is put in motion and a slurry material is applied and spread over the surface of the belt pad. Once the belt pad having slurry on it is moving at a desired rate, the wafer is lowered onto the surface of the belt pad. In this manner, wafer surface is substantially planarized. The wafer may then be cleaned in a wafer cleaning system.

FIG. 1A shows a linear polishing apparatus 10 typically utilized in a CMP system. The linear polishing apparatus 10 polishes away materials on a surface of a semiconductor wafer 16. The material being removed may be a substrate material of the wafer 16 or one or more layers formed on the wafer 16. Such a layer typically includes one or more of any type of material formed or present during a CMP process such as, for example, dielectric materials, silicon nitride, metals (e.g., aluminum and copper), metal alloys, semiconductor materials, etc. Generally, CMP may be utilized to polish the one or more of the layers on the wafer 16 to planarize a surface layer of the wafer 16.

The linear polishing apparatus 10 utilizes a polishing belt 12, which moves linearly with respect to the surface of the wafer 16. The belt 12 is a continuous belt. A motor typically drives the rollers so that the rotational motion of the rollers 20 causes the polishing belt 12 to be driven in a linear motion 22 with respect to the wafer 16.

A wafer carrier 18 holds the wafer 16, which is held in position by mechanical retaining ring and/or by vacuum.

The wafer carrier positions the wafer atop the polishing belt 12 so that the surface of the wafer 16 comes in contact with a polishing surface of the polishing belt 12.

FIG. 1B shows a side view of the linear polishing apparatus 10. As discussed above in reference to FIG. 1A, the wafer carrier 18 holds the wafer 16 in position over the polishing belt 12 while applying pressure to the polishing belt. The polishing belt 12 is a continuous belt typically made up of a polymer material such as, for example, the IC 1000 made by Rodel, Inc. layered upon a supporting layer. The rollers 20 rotate, moving the polishing belt in the linear motion 22 with respect to the wafer 16. In one example, a fluid bearing platen 24 supports a section of the polishing belt under the region where the wafer 16 is applied. The platen 24 can then be used to apply fluid against the under surface of the supporting layer of the belt pad. The applied fluid thus forms a fluid bearing that creates a polishing pressure on the underside of the polishing belt 12 that is applied against the surface of the wafer 16.

The above described linear polishing apparatus 10 functions well for most CMP operations when used with a supported polishing belt 12, such as a stainless steel belt having a polymer material covering. However, more efficient polishing belts 12 are currently available that are not supported. Since supporting material, such as stainless steel, does not form part of an unsupported polishing belt 12, unsupported polishing belts 12 often are easier to ship, higher quality, and less expensive to construct. As a result, unsupported polishing belts 12 generally are desirable to use in linear polishing systems.

Unfortunately, current linear polishing apparatuses 10 often perform poorly when polishing copper layers using an unsupported polishing belt 12. For example, FIG. 1C is an illustration showing an edge of a wafer 16 having a copper layer. The exemplary wafer 16 edge includes a copper layer 50 disposed over a dielectric layer 52. As is well known in the art, a slight raised section 54 occurs on copper layers 50 near the edge of the wafer 16 because of the particular properties of copper. As a result, it is desirable to increase the removal rate of the polishing process near the edge of the wafer during planarization of copper layers 50 to planarize the raised section 54.

Prior art linear polishing apparatuses generally can achieve an increased removal rate along the edge of the wafer 16 using a supported polishing belt, as illustrated in FIG. 2A. FIG. 2A is a graph 200 showing a removal rate using a supported polishing belt as a function of the distance from the center to the edge of a wafer. When using a supported polishing belt, such as a stainless steel supported polishing belt, the removal rate at the edge of the wafer can be increased dramatically, as shown in graph 200. In particular, the removal rate can be increased at a wafer radius of about 90 mm, which is about the radius of the slight raised section, which occurs on copper layers near the edge of the wafer.

However, as discussed previously, more efficient polishing belts are currently available that are not supported. As a result, unsupported polishing belts generally are desirable to use in linear polishing systems. Unfortunately, as mentioned above, conventional linear polishing apparatuses often perform poorly when polishing copper layers using an unsupported polishing belt, as illustrated in FIG. 2B. FIG. 2B is a graph 250 showing removal rate using an unsupported polishing belt as a function of the distance from the center to the edge of a wafer. As shown in graph 250, when using an unsupported belt in a conventional linear polishing apparatus, the removal rate at a wafer radius of about 90 mm is still slow and does not increase significantly until about 95–97 mm, which is beyond the radius of the slight raised section in the copper layer 50. As a result, it is difficult to effectively polish a copper layer 50 using an unsupported belt in a conventional linear polishing apparatus.

In view of the foregoing, there is a need for an apparatus that allows effective polishing of copper layers using unsupported polishing belts.

SUMMARY OF THE INVENTION

Broadly speaking, the present invention fills these needs by providing an air bearing platen with a raised topography to constrain airflow under a wafer. The raised topography of the platen allows enhanced edge removal rate uniformity control when using an unsupported polishing belt. In one embodiment, a CMP apparatus for enhancing removal rate uniformity is disclosed. The CMP apparatus includes a polishing belt disposed below a carrier head that is capable of applying a wafer to the polishing belt. Also included is a platen disposed below the polishing belt. The platen includes a circular shim section disposed on the top surface of the platen. The circular shim section is higher than the top surface of the platen. When using this configuration, increasing pressure to the backside of the polishing belt decreases the edge removal rate of the wafer. Conversely, decreasing pressure to the backside of the polishing belt increases the edge removal rate of the wafer.

A raised topography platen for use in a CMP system is disclosed in an additional embodiment of the present invention. The raised topography platen has a top surface disposed below the polishing belt, and a circular shim section disposed on the top surface of the platen. As above, the circular shim section is higher than the top surface of the platen. In addition, the circular shim section is capable of contacting the backside of the polishing belt during a planarization operation. Optionally, fluid pressure apertures, which provide fluid pressure to the backside of the polishing belt, can be disposed in the top surface of the platen. In one aspect, fluid pressure can be provided only from fluid pressure apertures disposed within the circular shim section. In this case, a closed volume can be formed between the circular shim section, the top surface of the platen, and the backside of the polishing belt during a planarization operation. Also optionally, the circular shim section can be disposed on a circular shim mount, which can be capable of being removed from the platen. In this aspect, the circular shim section can be either incorporated into the circular shim mount, or capable of being removed from the circular shim mount.

In a further embodiment, a method for performing CMP operations using a linear CMP apparatus is disclosed. The method includes providing a circular shim section disposed above a top surface of a platen. As above, the circular shim section is higher than the top surface of the platen. A wafer is then applied to a polishing belt, which his disposed above the platen, using a predefined downforce pressure. Because of the shim, pressure to a backside of the polishing belt is increased to decrease the edge removal rate of the wafer. Conversely, to increase the edge removal rate of the wafer, pressure to a backside of the polishing belt is decreased. As above, the circular shim section can be mounted on a circular shim mount, which is attached to the platen using screws. In this aspect, each screw is located outside a circumference of a wafer during a planarization process. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for an air bearing platen with a raised topography to constrain airflow under a wafer. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1A:
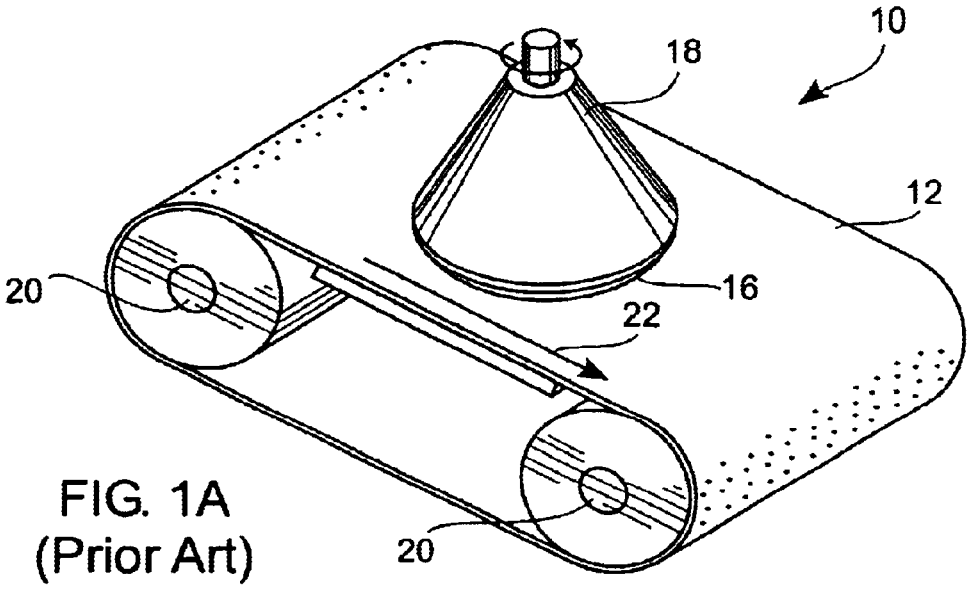
FIG. 1A (Prior Art)
FIG. 1A shows a linear polishing apparatus typically utilized in a CMP system.
Figure 1B:
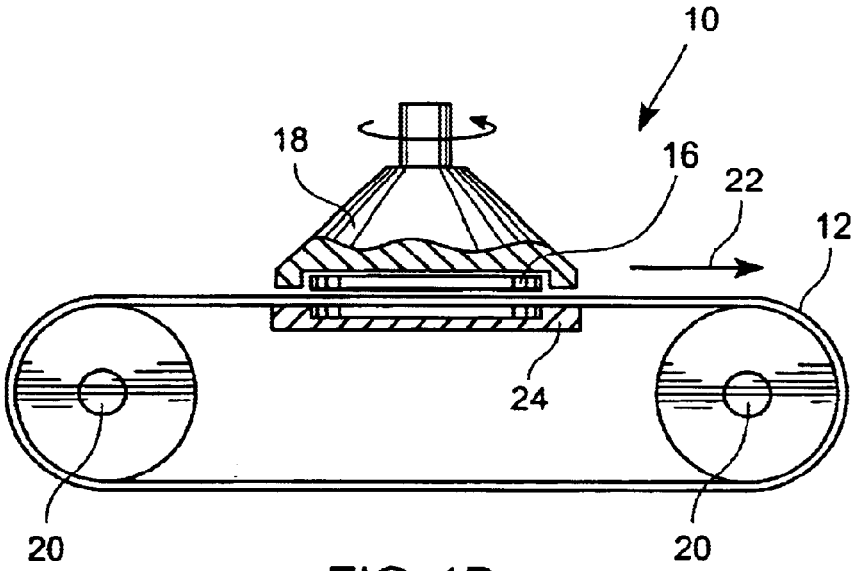
FIG. 1B (Prior Art)
FIG. 1B shows a side view of the linear polishing apparatus.
Figure 1C:
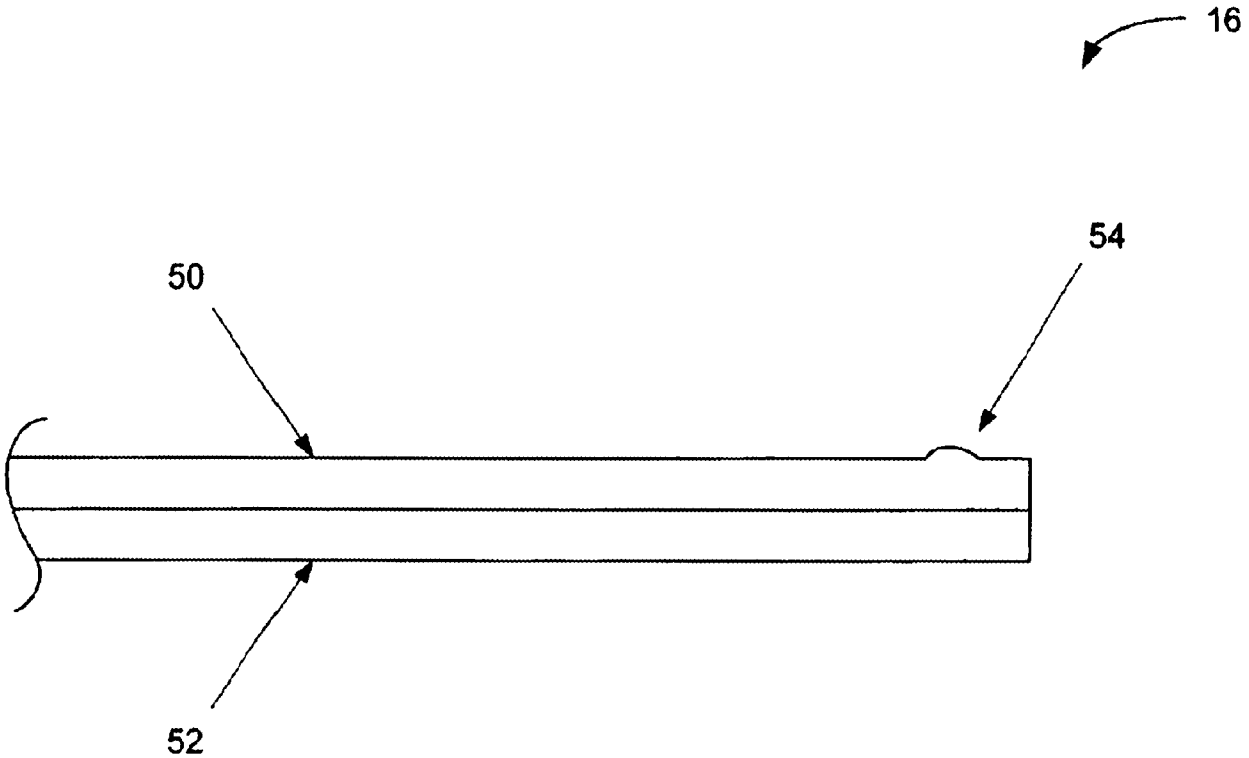
FIG. 1C (Prior Art)
FIG. 1C is an illustration showing an edge of a wafer having a copper layer.
Figure 2A:
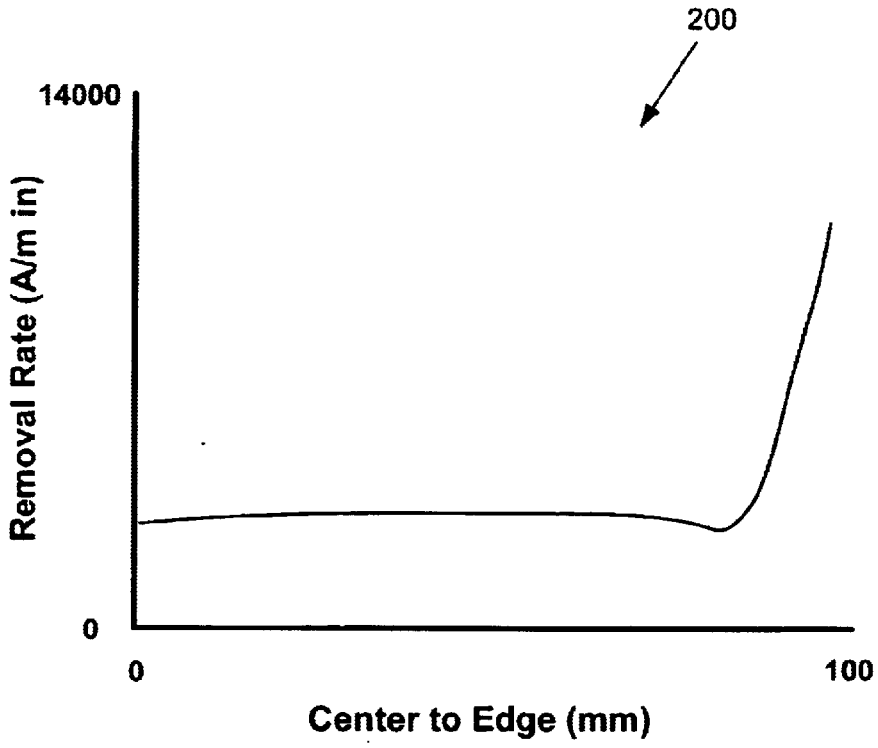
FIG. 2A (Prior Art)
FIG. 2A is a graph showing a removal rate using a supported polishing belt as a function of the distance from the center to the edge of a wafer.
Figure 2B:
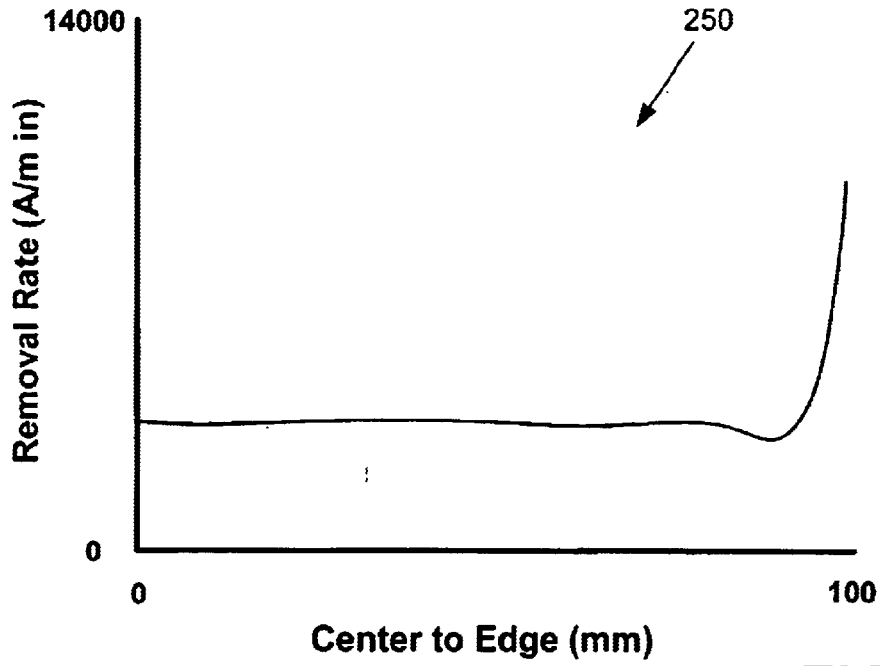
FIG. 2B (Prior Art)
FIG. 2B is a graph showing removal rate using an unsupported polishing belt as a function of the distance from the center to the edge of a wafer.
Figure 3:
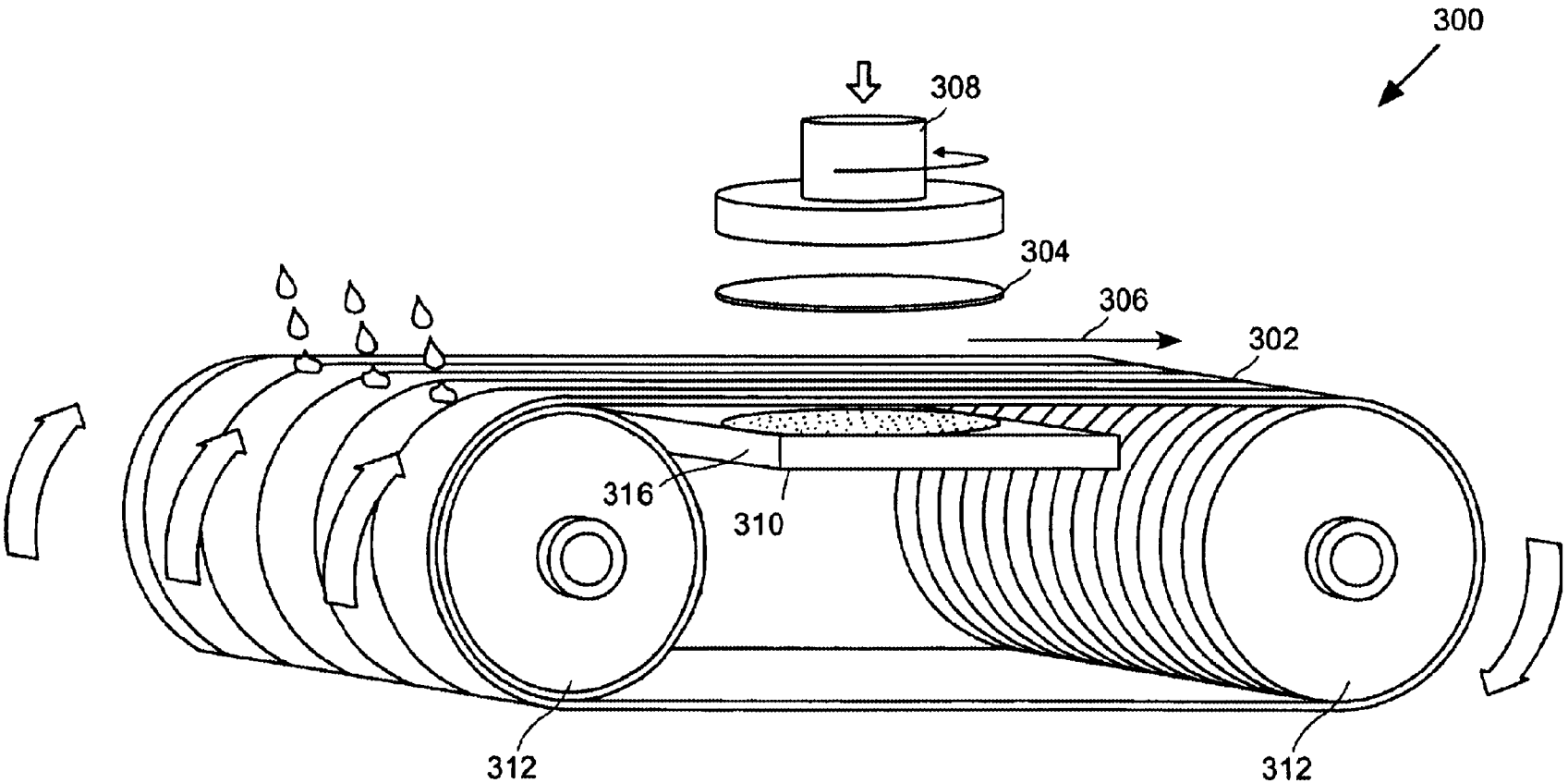
FIG. 3 shows a side view of a linear wafer polishing apparatus optimized for use with an unsupported polishing belt, in accordance with an embodiment of the present invention.

FIGS. 1A–2B have been described in terms of the prior art. FIG. 3 shows a side view of a linear wafer polishing apparatus 300 optimized for use with an unsupported polishing belt, in accordance with an embodiment of the present invention. The linear wafer polishing apparatus 300 includes a carrier head 308, which secures and holds a wafer 304 in place during processing. In addition, an unsupported polishing belt 302 forms a continuous loop around rotating drums 312, and generally moves in a direction 306 at a speed of about 400 feet per minute, however this speed may vary depending upon the specific CMP operation. As the polishing belt 302 moves during the CMP process, the carrier head 308 rotates and lowers the wafer 304 onto the top surface of the unsupported polishing belt 302, thus loading it with required polishing pressure.

A fluid bearing platen manifold assembly 310 supports the polishing belt 302 during the polishing process. Supporting the platen manifold assembly 310 is platen surround plate 316, which holds the platen manifold assembly 310 in place. To provide a fluid bearing for the polishing belt 302 during CMP operations, gas pressure is inputted through the platen manifold assembly 310 from a gas source. A plurality of independently controlled output holes provides upward force on the polishing belt 302 to control the polishing pad profile.

As discussed previously, the edge removal rate can be controlled on a polishing belt constructed of a polyurethane disposed on supporting material, such as stainless steel. However, when using a flexible, unsupported disposable polyurethane polishing belt, edge removal rate control is difficult using a conventional CMP apparatus. This is because an unsupported belt is not responsive to the influence of a conventional platen to control removal rate uniformity at the edge of the wafer surface, as illustrated above with respect FIG. 2B.

Figure 4A:
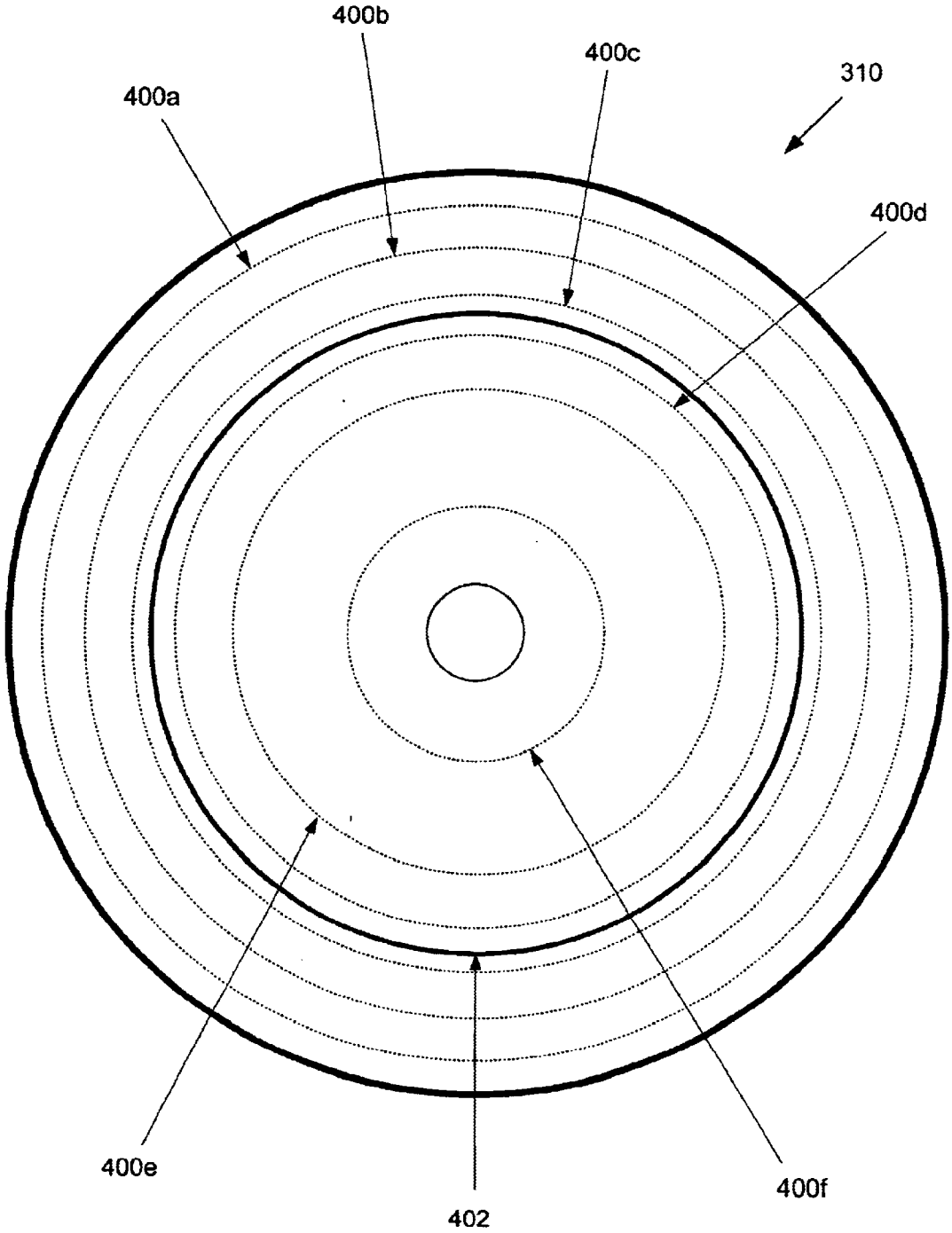
FIG. 4A shows a top view of a raised topology platen, in accordance with an embodiment of the present invention.

Embodiments of the present invention advantageously provide control of the removal rate uniformity at the edge of the wafer using a platen having, raised topography. FIG. 4A shows a top view of a raised topology platen 310, in accordance with an embodiment of the present invention. The raised topology platen 310 includes a plurality of independently controlled air pressure zones 400*a*–400*f* utilized to provide air pressure to the back of the polishing belt during CMP operations. Each air pressure zone 400*a*–400*f* comprises one or more concentric rings of air holes, which are used to provide air to the backside of the polishing belt. The air pressure provides an air bearing for the polishing belt to "ride" on during planarization. The air bearing also provides resistance to the downforce from the carrier head to allow polishing of the wafer surface. The independently controlled air pressure zones 400*a*–400*f* allow fine-tuning of the removal rate profile during the planarization process.

Further included in the raised topology platen 310 is a circular shim 402. In one embodiment, the circular shim 402 is disposed between air pressure zones 400*c* and 400*d*. In this configuration, the shim 402 can have a width of about 4–6 millimeters (mm), an inner radius of about 96 mm, and an outer radius of about 100 mm. The exemplary embodiment illustrated in FIG. 4A is designed for use with a 200 mm wafer. However, it should be noted that the size of the shim 402 can be varied to fit any wafer size. For example, the shim 402 can have an inner radius of about 146 mm, and an outer radius of about 150 mm to accommodate a 300 mm wafer. In addition, the width of the shim 402 can be varied to achieve different removal rate profiles. Moreover, the diameter of the shim 402 can be varied to modify the inflection point of the removal rate profile, as will be described in greater detail subsequently. In operation, the shim 402 restricts airflow under the polishing belt, allowing for enhanced control of the removal rate profile when using an unsupported polishing belt as illustrated next with respect to FIG. 4B.

Figure 4B:
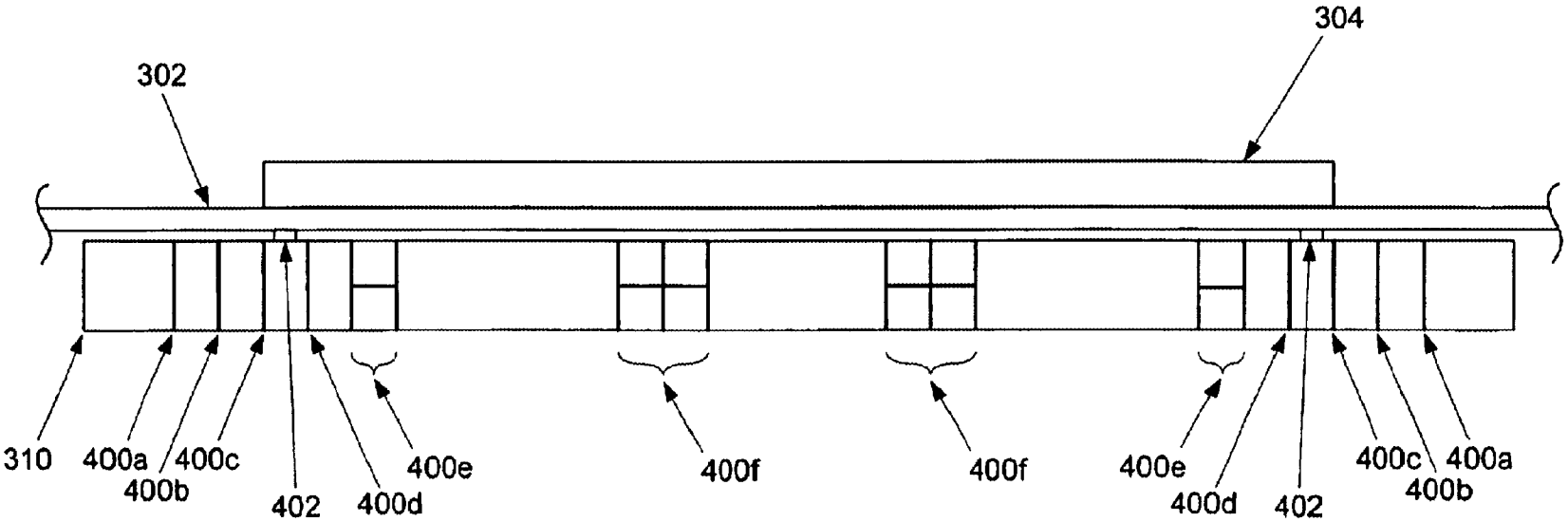
FIG. 4B shows a side view of a raised topology platen, in accordance with an embodiment of the present invention.

FIG. 4B shows a side view of a raised topology platen 310, in accordance with an embodiment of the present invention. As described above, the raised topology platen 310 includes a plurality of independently controlled air pressure zones 400*a*–400*f* utilized to provide air pressure to the back of the polishing belt during CMP operations. Each air pressure zone 400*a*–400*f* comprises one or more concentric rings of air holes, which are used to provide air to the backside of the polishing belt. For example, air pressure zone 400*e* can comprise two connected concentric rings of air holes, and air pressure zone 400*f* can comprise three connected concentric rings of air holes. It should be noted, however, that the air zone placement and configuration illustrated in FIG. 4B is for illustrative purposes. Other air zone placement configurations can be utilized in conjunction with the embodiments of the present invention, as desired.

Also shown in FIG. 4B, is a wafer 304 disposed above an unsupported polishing belt 302. Disposed between air pressure zones 400*c* and 400*d* is the circular shim 402. As mentioned above, the shim 402 can have a width of about 4–6 millimeters (mm), an inner radius of about 96 mm, and an outer radius of about 100 mm. In addition, the shim 402 can have a height of between about 3–25 mil. For example, the shim 402 illustrated in FIG. 4B has a height of about 11 mil. As mentioned above, the shim 402 restricts airflow under the polishing belt, allowing for enhanced control of the removal rate profile when using an unsupported polishing belt 302. In particular, depending on the air pressure provided under the polishing belt 302 via the air pressure zones 400*a*–400*f*, the edge profile can be made slow or fast.

For example, when the air pressure provided under the polishing belt is relatively high, the polishing belt 302 "rides" on a cushion of air such that the shim 402 does not contact the back of the polishing belt 302. As a result, the wafer 304 does not place a large load on the shim 402 when the wafer 304 is applied to the polishing belt 302 during a CMP operation, as illustrated in FIG. 5.

Figure 5:
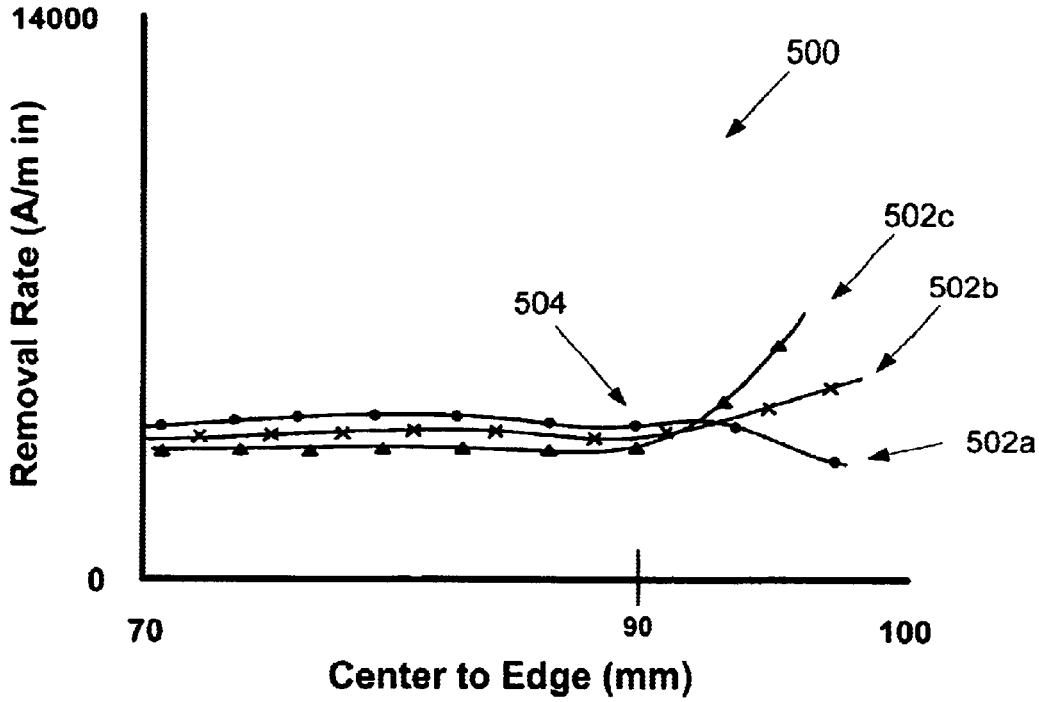
FIG. 5 is a graph showing a plurality of removal rate profiles using a raised topography platen, in accordance with an embodiment of the present invention.

FIG. 5 is a graph 500 showing a plurality of removal rate profiles using a raised topography platen 310, in accordance with an embodiment of the present invention. The graph 500 illustrates various removal rate profiles 502*a*–502*c* for different air pressure settings. For example, removal rate profile 502*a* illustrates the removal rate near the edge of the wafer when the air pressure provided to the back of the polishing belt 302 is relatively high. The high air pressure raises the polishing belt 302 above the shim 402 during polishing. In this case, the wafer 304 does not place a large load on the shim 402 when the wafer 304 is applied to the polishing belt 302 and the removal rate is low near the edge of the wafer 304.

As the air pressure provided to the back of the polishing belt 302 is lowered, the removal rate near the edge of the wafer increases. For example, removal rate profile 502*c* illustrates the removal rate near the edge of the wafer when the air pressure provided to the back of the polishing belt 302 is relatively low. Because the air pressure is low, the polishing belt 302 contacts the shim 402 during polishing. In this case, the wafer 304 places a larger load on the shim 402 when the wafer 304 is applied to the polishing belt 302. In this case, the shim 402 increases the removal rate near the edge of the wafer 304.

In one embodiment, referring to FIG. 4B, only air pressure zones 400*e* and 400*f* are used to achieve the removal rate profiles illustrated in the graph 500 of FIG. 5. In this embodiment, the design and air pressure controls for the platen 310 can be substantially simplified because only two air pressure zones 400*e* and 400*f* are needed. Further, when a low air pressure is utilized such that the polishing belt 302 contacts the shim 402 during polishing, a closed volume is formed between the platen 310, the shim 402, and the polishing belt 302. In this case, air ceases to flow when the closed volume is formed. As a result, the total airflow utilized by the raised topography platen 310 can be substantially reduced. For example, the raised topography platen 310 of the embodiments of the present invention reduces the total airflow used during CMP operations by between 70–85% from airflow utilized by conventional platens.

As illustrated in graph 500 of FIG. 5, the inflexion point 504 for the various air pressure removal rate profiles 502*a*–502*c* is at about 90 mm from the center of the wafer using the shim described above with respect to FIG. 4B. The inflexion point 504 defines the point at which the removal rate starts to increase or decrease at the edge of the wafer with respect to the total removal rate over the entire surface during polishing. This is important because of deposition effects caused at the edge of the wafer during the application of Metals/Oxides/etc. However, the inflexion point 504 can be moved to a different radius by varying the width of the shim 402 and/or the diameter of the shim 402. For example, the inflexion point 504 can be moved closer to the edge of the wafer by increasing the diameter of the shim 402.

Figure 6:
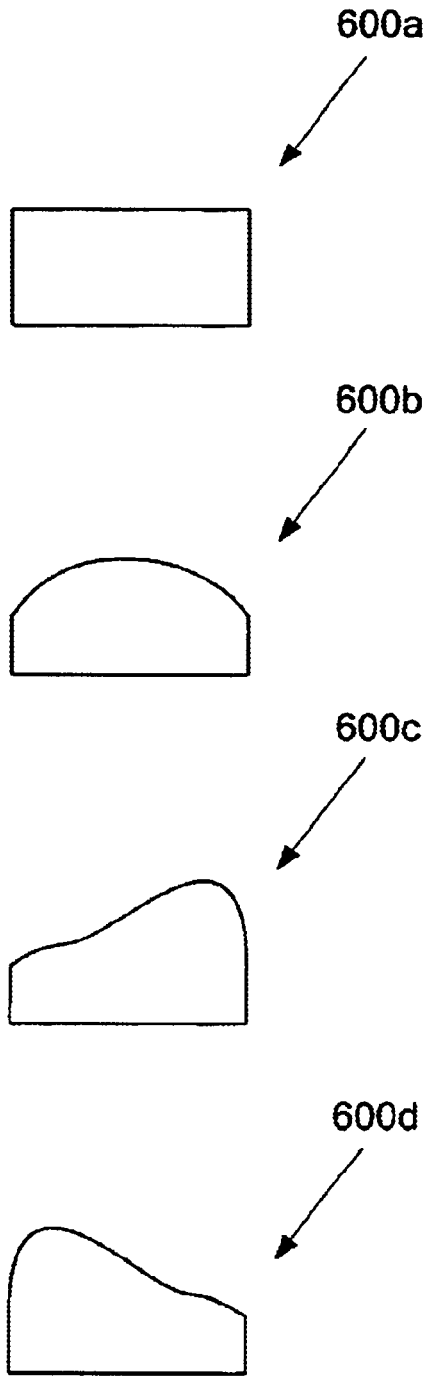
FIG. 6 illustrates a plurality of shim profiles, in accordance with an embodiment of the present invention.

Further control of edge removal rate uniformity can be obtained by changing the profile of the shim. FIG. 6 illustrates a plurality of shim profiles 600*a*–600*d*, in accordance with an embodiment of the present invention. Shim profile 600*a* is the shape illustrated in FIG. 4B. Shim profile 600*b*, for example, can be used to increase the life of the shim. That is, the rounded profile characteristics of shim profile 600*b* can reduce the amount of erosion occurring to the edges of the shim.

Shim profiles 600*c* and 600*d* can be utilized to increase the velocity of escaping gas. As the velocity of escaping gas is increased, the pressure in that area is decreased resulting in a slower removal rate. As discussed with respect to FIG. 5, the higher the air pressure used, and thus the more air that is used, the slower the removal rate. Thus, increasing the velocity of the escaping gas can be utilized to slow the removal rate using less airflow. Further, the width of the shim can varied at different points along the circumference of the shim. For example, the leading edge of the shim can be constructed narrower than the trailing edge of the shim.

The shim of the embodiments of the present invention can be constructed of either compliant and/or non-compliant materials. Non-compliant materials, such as silicon, Teflon, ultra high molecular weight polymers, and aluminum provide a low coefficient to friction ratio. As a result, wear is reduced when the shim contacts the back of the polishing belt during CMP operations, which increases the useful life of the shim. Compliant materials provide additional tuning based on the contact and pressure distribution since compliant materials allow the shim to conform more to the polishing belt. In addition, compliant materials can increase the seal formed with the polishing belt when using low pressure and forming a closed volume as described previously.

Figure 7A:
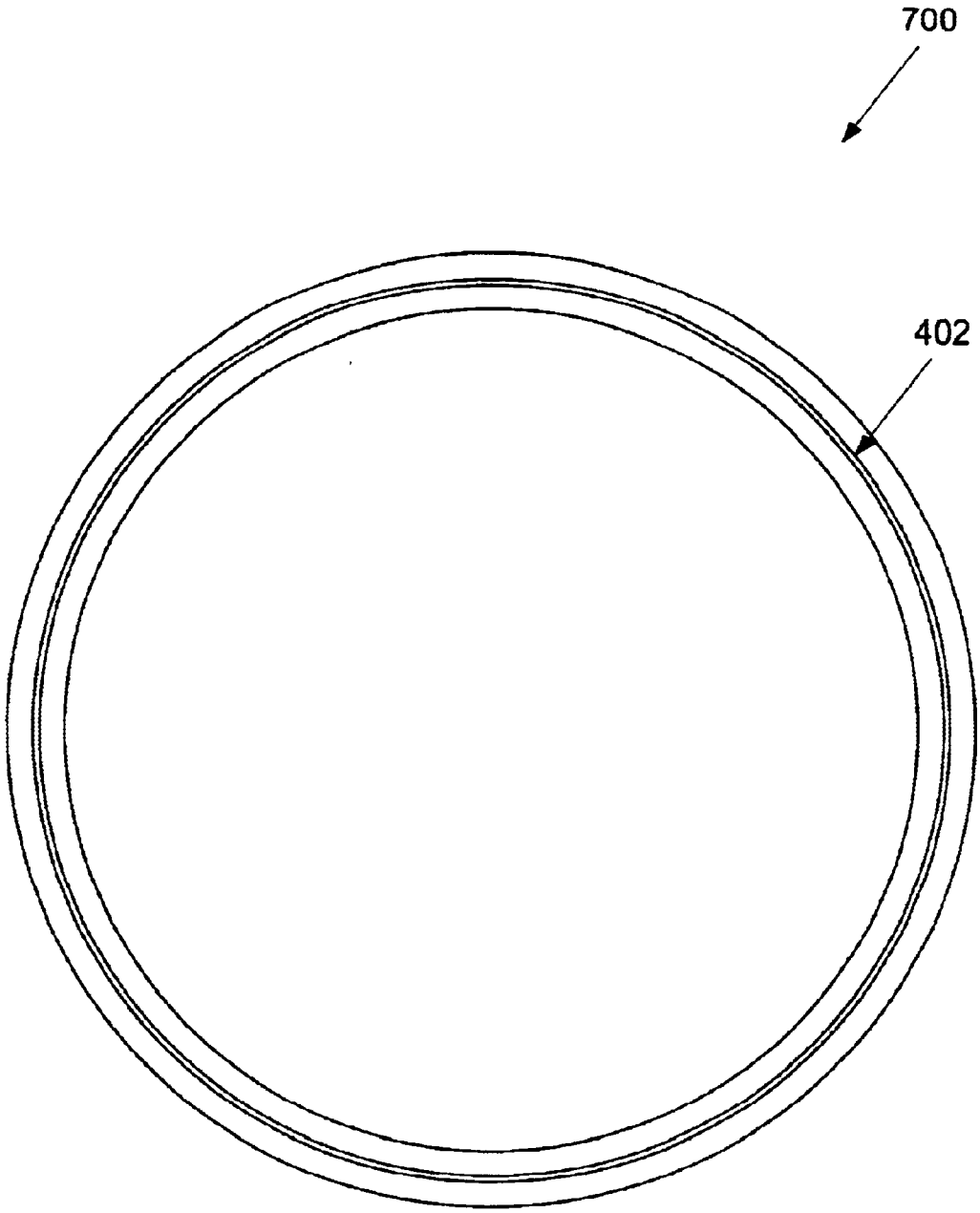
FIG. 7A illustrates a top view of a shim mount, in accordance with an embodiment of the present invention.

In addition to mounting the shim directly on the platen, one embodiment of the present invention provides a shim mount, which is utilized to mount the shim onto the platen. FIG. 7A illustrates a top view of a shim mount 700, in accordance with an embodiment of the present invention. As illustrated in FIG. 7A, the exemplary shim mount 700 is a circular mounting that fits within a recess of the platen. A shim 402 is positioned on the shim mount 700, and is utilized to enhance edge removal rate uniformity as described above. In one embodiment, the shim mount 700 has an outer radius of about 8.75 inches and an inner radius of about 7.0 inches for a 200 mm wafer, and an outer radius of about 12.67 inches and an inner radius of about 11 inches for a 300 mm wafer. It should be noted however that the above ranges are for exemplary purposes only. Actual sizes can vary depending on the exact application in which the shim and shim mount are utilized, as will be apparent to those skilled in the art after a careful reading of the present disclosure.

Figure 7B:
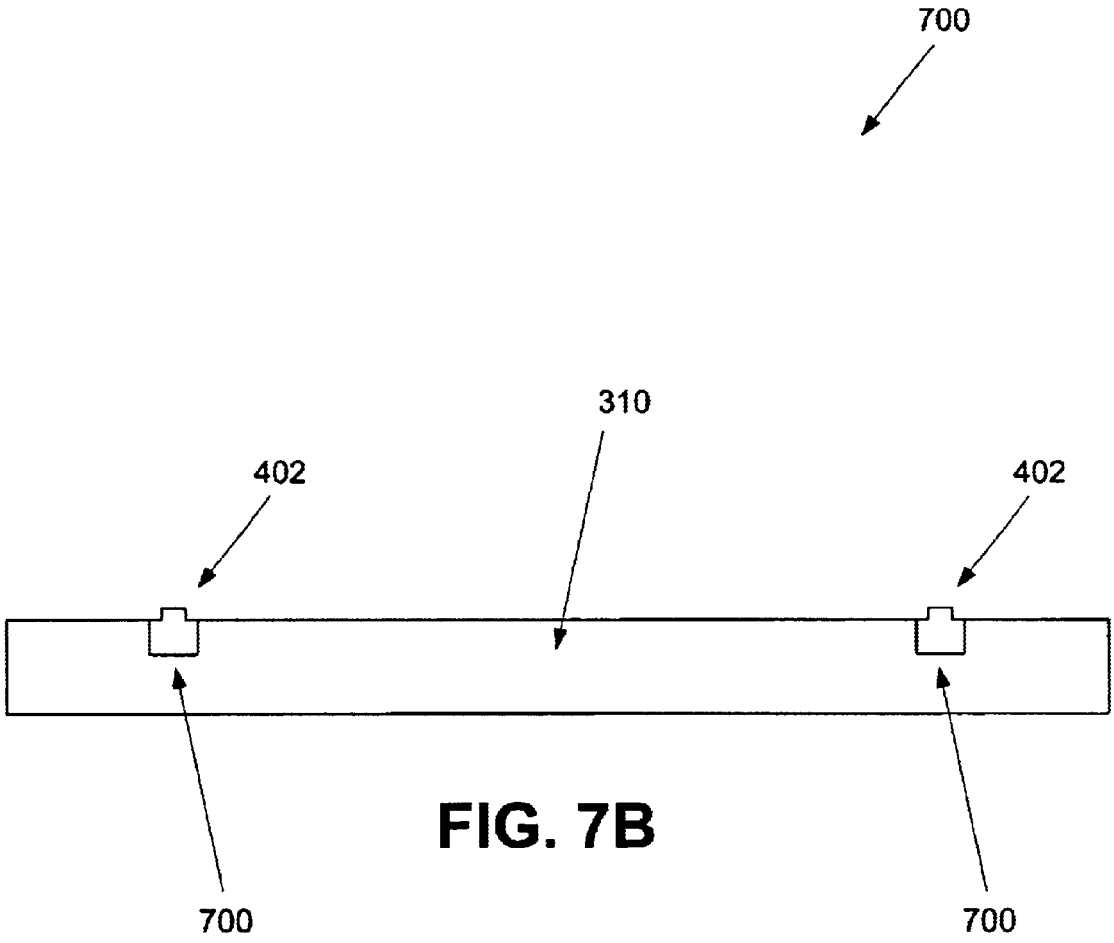
FIG. 7B illustrates a side view of a shim mount situated within a platen, in accordance with an embodiment of the present invention.

FIG. 7B illustrates a side view of a shim mount 700 situated within a platen 310, in accordance with an embodiment of the present invention. As illustrated in FIG. 7B, the shim mount fits within a recess of the platen. Although FIGS. 7A and 7B illustrate a shim mount 700 having an incorporated shim 402, it should be noted that a shim mount 700 can be manufactured without an incorporated shim 402. In this case, different shims 402 can be added to the shim mount 700 when the shim mount is removed from the CMP apparatus. This allows the shim mount 700 with a newly mounted shim 402 to be inserted into the shim mount recess of the platen 310, assuring proper shim 402 alignment within the CMP apparatus. In some embodiments, the shim mount 700 is attached to the platen 310 using screws, which are typically located outside the surface of the wafer during polishing. In this manner, the attachment screws do not impede airflow or otherwise affect the CMP process.

Figure 8:
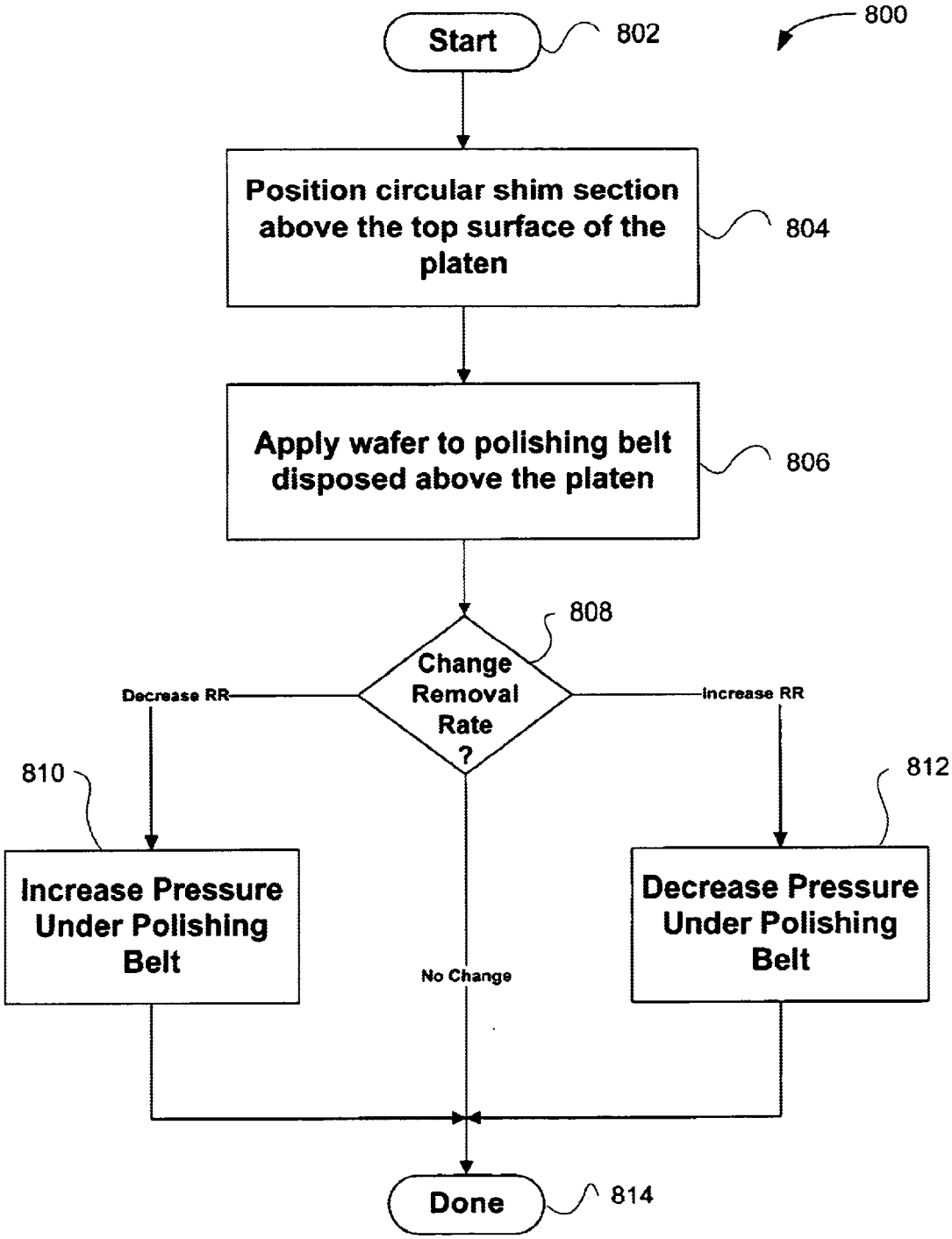
FIG. 8 is a flowchart showing a method for performing CMP using a linear CMP apparatus with a raised topography platen, in accordance with an embodiment of the present invention.

FIG. 8 is a flowchart showing a method 800 for performing CMP using a linear CMP apparatus with a raised topography platen, in accordance with an embodiment of the present invention. In an initial operation 802, preprocess operations are performed. Preprocess operations can include, for example, depositing material on the surface of the wafer, generating a mask on the surface of the wafer, etching a wafer layer, and other preprocess operations that will be apparent to those skilled in the art after a careful reading of the present disclosure.

In operation 804, a circular shim section is positioned above the top surface of the platen. The platen generally includes a plurality of independently controlled air pressure zones. Each air pressure zone comprises one or more concentric rings of air holes, which are used to provide air to the backside of the polishing belt. The air pressure provides an air bearing for the polishing belt to "ride" on during planarization.

The circular shim section can have a width of about 4–6 mm, an inner radius of about 96 mm, and an outer radius of about 100 mm for a 200 mm wafer. However, it should be noted that the size of the circular shim section can be varied to fit any wafer size. For example, the circular shim section can have an inner radius of about 146 mm, and an outer radius of about 150 mm to accommodate a 300 mm wafer. In addition, the width of the circular shim section can be varied to achieve different removal rate profiles. Moreover, the diameter of the circular shim section can be varied to modify the inflection point of the removal rate profile, as described above.

The wafer is applied to the polishing belt, which is disposed above the platen, in operation 806. When the wafer is applied to the polishing belt, the circular shim section restricts airflow under the polishing belt, allowing for enhanced control of the removal rate profile when using an unsupported polishing belt. In particular, depending on the air pressure provided under the polishing belt via the air pressure zones, the edge profile can be made slow or fast.

A decision is then made as to whether to change the removal rate at the edge of the wafer, in operation 808. As mentioned above, the removal rate at the edge of the wafer can be varied depending on the air pressure used during the planarization process. If the removal rate at the edge of the wafer should be decreased, the method 800 continues with operation 810. If the removal rate at the edge of the wafer should be increased, the method 800 continues with operation 812. Otherwise, the removal rate remains unchanged during the CMP operations and the method 800 ends in operation 814.

When the removal rate at the edge of the wafer should be decreased, the pressure under the polishing belt is increased, in operation 810. When the air pressure provided under the polishing belt is relatively high, the polishing belt "rides" on a cushion of air such that the circular shim section does not contact the back of the polishing belt. As a result, the wafer does not place a large load on the circular shim section when the wafer is applied to the polishing belt.

When the removal rate at the edge of the wafer should be increased, the pressure under the polishing belt is decreased, in operation 812. As the air pressure provided to the back of the polishing belt is lowered, the removal rate near the edge of the wafer increases. Because the air pressure is low, the polishing belt contacts the circular shim section during polishing. In this case, the wafer places a larger load on the circular shim section when the wafer is applied to the polishing belt, which increases the removal rate near the edge of the wafer. Post process operations are performed in operation 814. Post process operations can include, for example, wafer cleaning, further wafer masking and etching, and other post process operations that will be apparent to those skilled in the art after a careful reading of the present disclosure.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A chemical mechanical planarization (CMP) apparatus for enhancing removal rate uniformity, comprising:

a polishing belt disposed below a carrier head capable of applying a wafer to the polishing belt; and a platen disposed below the polishing belt, the platen having a circular shim section disposed on a top surface of the platen, the circular shim section being higher than the top surface of the platen.

2. A CMP apparatus as recited in claim 1, wherein increasing pressure to a backside of the polishing belt decreases an edge removal rate of the wafer.

3. A CMP apparatus as recited in claim 1, wherein decreasing pressure to a backside of the polishing belt increases an edge removal rate of the wafer.

4. A CMP apparatus as recited in claim 1, wherein the circular shim section is mounted on a circular shim mount.

5. A CMP apparatus as recited in claim 4, wherein the circular shim mount is positioned with a recess in the platen.

6. A CMP apparatus as recited in claim 4, wherein the circular shim section is incorporated into the circular shim mount.

7. A CMP apparatus as recited in claim 4, wherein the circular shim section is capable of being removed from the circular shim mount.

8. A raised topography platen for use in a chemical mechanical polishing system, comprising:

a top surface disposed below the polishing belt; and a circular shim section disposed on the top surface of the platen, the circular shim section being higher than the top surface of the platen, wherein the circular shim section is capable of contacting a backside of the polishing belt during a planarization operation.

9. A raised topography platen as recited in claim 8, further comprising fluid pressure apertures disposed in the top surface of the platen, the fluid pressure apertures capable of providing fluid pressure to the backside of the polishing belt.

10. A raised topography platen as recited in claim 9, wherein fluid pressure is provided only from fluid pressure apertures disposed within the circular shim section.

11. A raised topography platen as recited in claim 8, wherein a closed volume is formed between the circular shim section, the top surface of the platen, and the backside of the polishing belt during a planarization operation.

12. A raised topography platen as recited in claim 8, wherein the circular shim section is disposed on a circular shim mount, the circular shim mount being capable of being removed from the platen.

13. A raised topography platen as recited in claim 11, wherein the circular shim section is incorporated into the circular shim mount.

14. A raised topography platen as recited in claim 11, wherein the circular shim section is capable of being removed from the circular shim mount.

* * * * *